US005110232A

United States Patent [19]

Jermann

[11] Patent Number: 5,110,232

[45] Date of Patent: May 5, 1992

[54] BINDER

[76] Inventor: Peter D. Jermann, 117 S. 14th St., Olean, N.Y. 14760

[21] Appl. No.: 694,391

[22] Filed: May 1, 1991

[51] Int. Cl.[5] ..... B42F 3/00

[52] U.S. Cl. ..... 402/8; 402/12; 281/18

[58] Field of Search ..... 402/8, 2, 9, 12; 281/18

[56] References Cited

U.S. PATENT DOCUMENTS

| | | | |
|---|---|---|---|
| 194,230 | 8/1877 | England . | |
| 251,998 | 1/1882 | Colton . | |
| 516,519 | 3/1894 | Brundage . | |
| 637,689 | 11/1899 | Wise . | |
| 1,217,013 | 2/1917 | Killingsworth . | |
| 1,408,870 | 3/1922 | Engel . | |
| 1,496,335 | 6/1924 | Benett | 402/8 X |
| 1,603,538 | 10/1926 | Helfer | 402/8 X |
| 1,940,733 | 12/1933 | Seelman, Jr. | 402/8 X |

FOREIGN PATENT DOCUMENTS 1864 1/1911 United Kingdom .

*Primary Examiner*—Timothy V. Eley
*Assistant Examiner*—Willma Fridie, Jr.
*Attorney, Agent, or Firm*—Bean, Kauffman & Spencer

[57] ABSTRACT

The instant invention features a novel binder having opposing panels, with a first panel having a binding strap gripping means at an edge of a first end of the panel and a binding strap extending from a second end of the panel such that the binding strap can be extended from the second end of the panel, around and/or through the second panel back to the first end of the gripping means of the first panel. Such arrangement allows securing of the second panel in adjustable, opposing juxtaposition to the first panel, thereby securing loose papers between the panels.

19 Claims, 3 Drawing Sheets

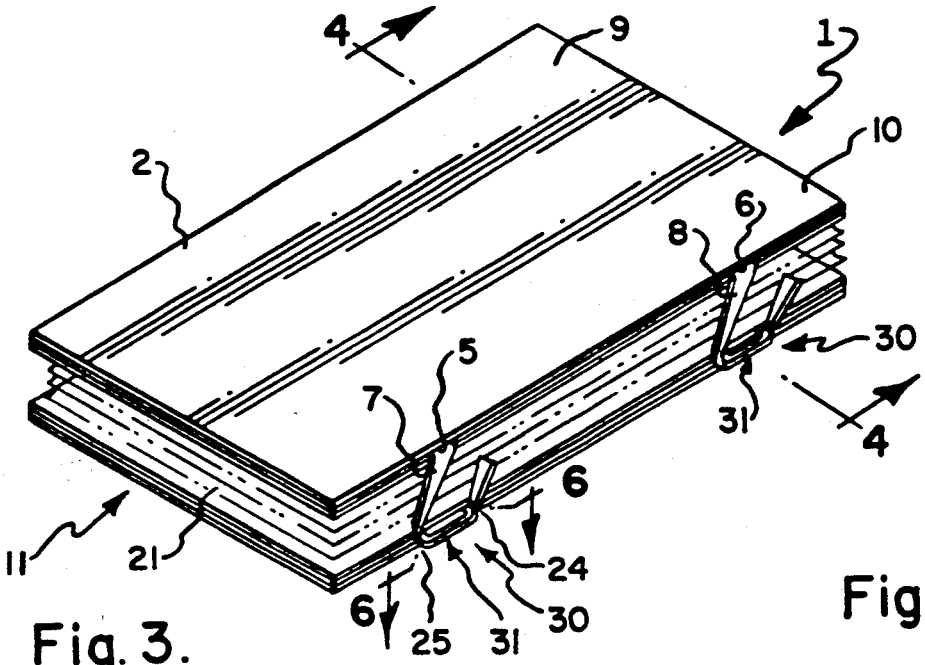
Fig. 3.
Fig. 6.
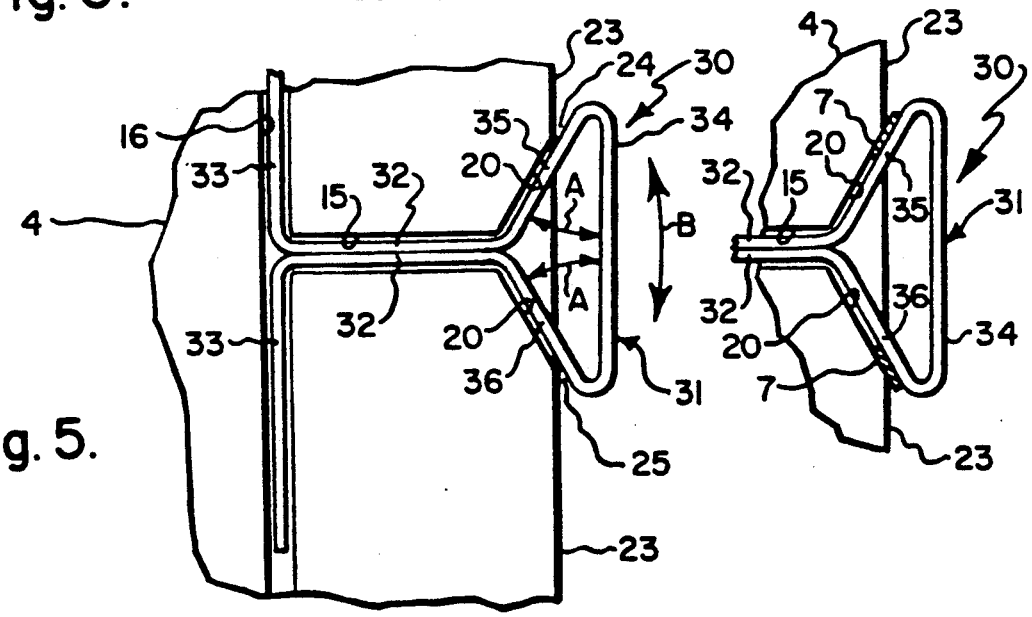
Fig. 5.
Fig. 4.
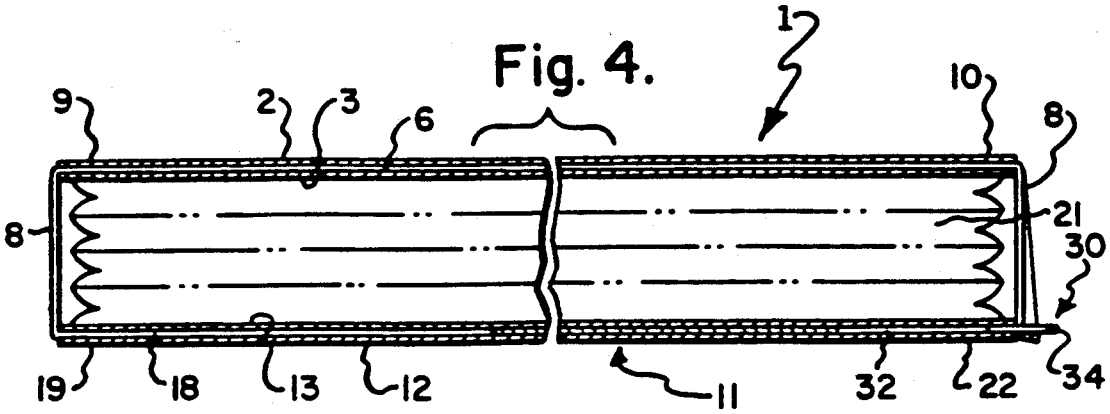

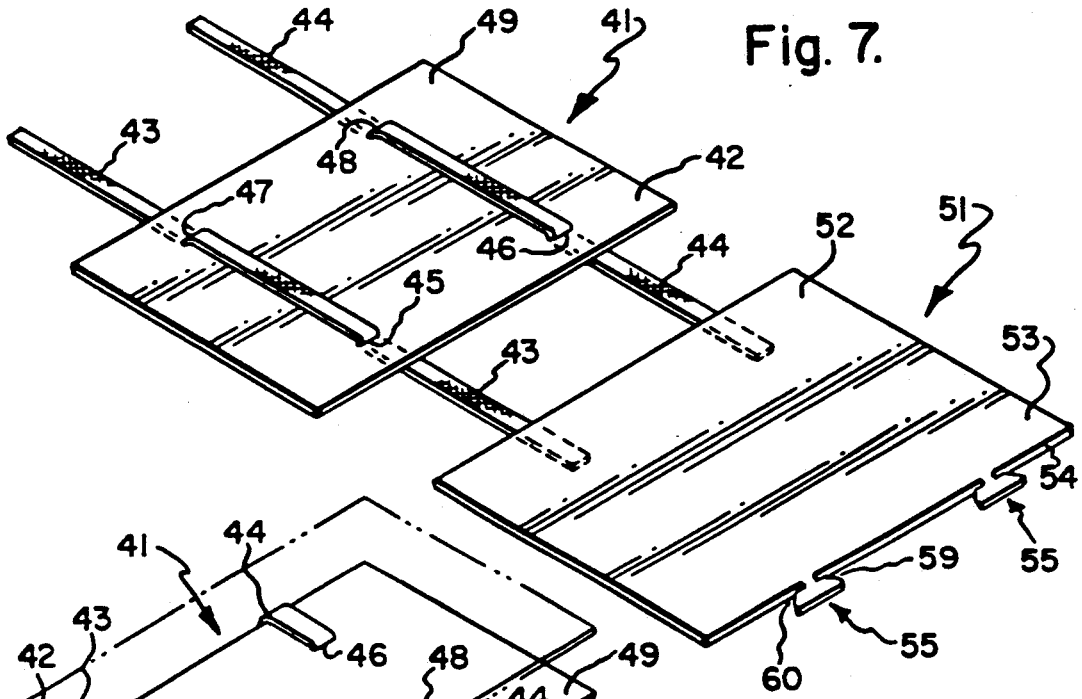
Fig. 7.
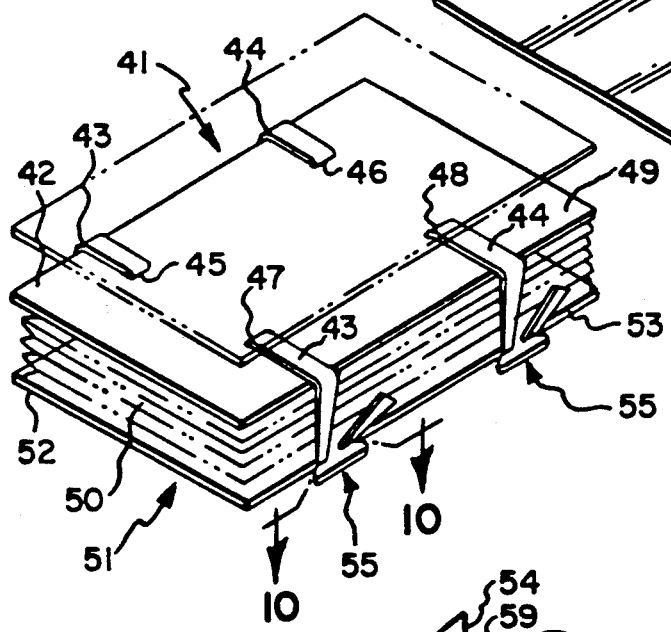
Fig. 8.
Fig. 10.
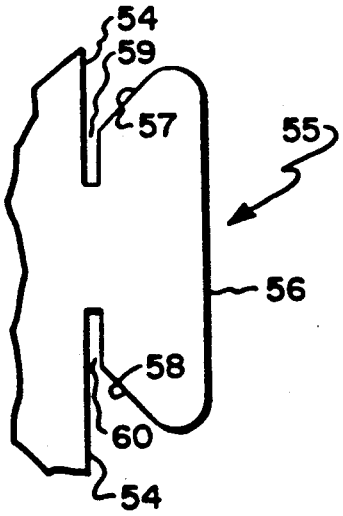
Fig. 9.
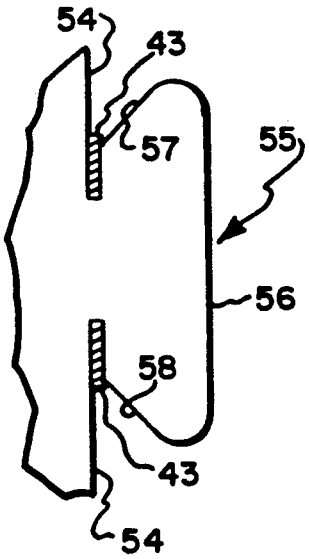

BINDER

FIELD OF THE INVENTION

This application relates to a novel expandable binder having particular utility for removably binding loose papers, magazines and the like between organizing covers.

BACKGROUND OF THE INVENTION

There is a continuing need for an efficient means to secure and/or organize documents such as loose papers, magazines, pamphlets and the like in easily removable bound arrangement. To that end, various devices have been produced that provide unique methods to hold such loose documents.

One such device is the ring type, loose leaf binder, that relies upon two or more rings permanently engaged in a backing spine between a front and rear cover. Such ring type binders require the documents to have holes arranged to conform to the ring arrangement and are typically rejected for use when it is desired to maintain the document in its original form.

Another type of device commonly used to hold loose documents and the like is the expanding folder. Expanding folders, typically referred to as manila folders, generally comprise a paper wallet, in which documents and the like can be stored, with a top flap, typically secured by a cloth strap or the like encircling the folder. Such folders have the ability to hold many sizes and shapes of loose documents but generally are not sufficiently self-supporting to be neatly arranged on typical book shelving in standing side-by-side order.

A further type of device generally used to secure loose documents and the like is generally termed a binder. U.S. Pat. No. 637,689 describes one such binder, comprising a single rectangular wrapper formed from a semi-rigid material and comprising two parallel fold points. The fold points are arranged to flank a central area such that the outer portions of the wrapper can be folded over the central area and loose papers and the like arranged in the central area will be secured thereby. U.S. Pat. No. 194,230 describes another such binder wherein two leaves are connected by a flexible fullness of leather so as to permit the leaves to fold like a book. A set of cords connects the leaves and tensions a spring carrying a clasp for fastening the leaves.

U.S. Pat. No. 251,998 describes a further binder comprising opposing covers, having eyelets in two opposing adjacent corners. One cover also contains a belaying pin on its planar surface. Provision is made for stringing a cord through the eyelets of the covers and around the belaying pin, with another cord attached to a mid-point of the first cord in such manner that pulling the second cord moves the covers toward each other. The second cord can be secured to the belaying pin to secure the distance between covers. U.S. Pat. No. 516,519 discloses a similar binder to that of U.S. Pat. No. 251,998, wherein the cords are secured to a cleat arranged on an inner surface of a cover.

U.S. Pat. No. 1,408,870 discloses a binder wherein opposing covers comprise opposing slots that contain an apertured strap therebetween. A further tie strap is strung through the apertures for encirclement of the covers and securing the covers in adjustable opposing relationship. U.S. Pat. No. 1,217,013 discloses a display device wherein an elastic strap is used to secure opposing covers.

An object of the present invention is to provide a novel binder for securing loose documents and the like, that will expand and contract in generally close response to the bulk thickness of the documents being secured.

Another object of the invention is to provide a novel binder that will secure loose documents in generally ordered, rectangular arrangement for efficient and convenient storage on shelving.

A still further object of the invention is to provide a binder that can secure loose documents in bound book-like arrangement, that allows convenient standing, side-by-side arrangement on shelving. These and other objects of the invention will become apparent from the following description of the invention.

SUMMARY OF THE INVENTION

The instant invention features a novel binder that generally comprises first and second panels, each panel having a hinging end and an opening end in respective opposing relationship to each other; said first panel comprising gripping means for gripping a flexible binding strap at an edge of said opening end of said panel; flexible binding strap means extending from said hinging end of said first opposing panel to an opposing hinging end of said second panel, continuing therefrom to the opening end of said second panel and to said gripping means at an edge of the opening end of said first panel; said binding strap being arranged to engage said second panel in adjustable, opposing, juxtaposition to said first panel, by engagement with said gripping means along said strap.

The panels of the invention can be in any convenient polygonal shape or form, but generally a rectangular shape is preferred for organizational convenience when the binder is to be used on conventional shelving. Similarly, though, the panels are typically generally planar, they may be ornamentally decorated with embossing, raised decorative ornamentation, padding and the like, depending upon the preference of the user. Generally it is preferred that the panels be rigid, or at least semi-rigid, so as to provide sufficient structural strength to the binder, to be self-supporting when placed on end.

Typically, a panel can be formed from a cellulosic material such as a pressed paper, cardboard, wood or the like, preferably in laminate structure, and contains a decorative exterior surface layer which may comprise the same or different material such as wood, leather, vinyl or the like. In a preferred embodiment, the panel is formed from a semi-rigid polymeric material, with or without a decorative exterior surface of paper, wood, leather or the like.

The binding strap can be made of any suitable material and preferably is in the form of a strap or belt, but can take the form of a rounded cord or the like. The strap can be leather, polymer or elasticized, but preferably it is comprised of a woven cloth manufactured from cotton, polyester, or the like. Though a single strap located generally central to the panels is effective in holding the panels together to secure loose papers and the like therebetween, typically it is preferred to have two or more straps securing a binder, spaced apart to engage the panels. Typically, when the panels are rectangular, two straps are preferred for securing the binder in parallel, spaced apart relationship.

The gripping means of the instant binder is intended to grip the binding strap and is contiguous with an edge of an opening end of a panel. The gripping means can be comprised of the same or different materials as a panel and can be of any convenient shape or form. When the panel is constructed from a relatively rigid or semi-rigid, wear resistant material, such as a polymeric, wood or stiff leather material, the gripping means can comprise an extension of the panel material formed at the opening edge of the panel. In a preferred embodiment of a gripping means, one or more edges of an extension of the panel material forms an open-ended slot with an edge of an opening end of the panel. Typically, the surfaces forming such slot diverge toward each other, at a closed end of the slot, to facilitate jam locking of the binder strap between the gripping means and an edge of the opening end of the panel. The edges comprising the slot can also be generally parallel. In such instance, the binder strap and the slot are dimensioned such that the strap is gripped by resistance to deformation of the strap, gripping means and/or panel edge. Such parallel arrangement has been found particularly effective when the panel is an extension comprised of a semi-rigid polymeric material. In a further embodiment, particularly useful when the gripping means comprises an extension of polymeric material of the panel, the slot is formed wholly within the extension and does not use an edge of the panel as an edge of the slot. Generally, it is preferred that such slot comprise parallel edges.

In general, dimensioning of the slot and disposition of the gripping surfaces is dependent upon the deformability of the materials of the gripping means, panel opening edge and/or binding strap. Thus, when the gripping means comprises a rigid, relatively non-deformable material, a panel opening edge and/or the binding strap should be deformable such that the strap can be jam locked into the slot. In a particularly preferred embodiment, a gripping means is positioned to form two slots with an opening edge of a panel such that a single wrap of a binding strap around the gripping means will jam lock at one or both slots to secure the binder. It should be understood that generally the surfaces comprising the slot can be relatively smooth and still efficiently lock the strap, however, roughened surfaces are contemplated as within the invention, including teeth or the like to adjustably secure the strap within the slot.

A gripping means, particularly useful when the panel material is relatively deformable, such as cardboard, pressed paper and the like, comprises a means affixed to the panel that protrudes from an edge of an opening end and functions contiguous with the panel edge to form one or more slots. In one embodiment of a gripping means, a rigid metal or plastic wire or the like is formed to comprise the general shape of a triangle. When affixed to the panel, a base and one or two acute angled legs, or portions thereof, of the triangle are arranged to extend from the edge of the opening end of the panel. In such arrangement, the leg(s) of the triangle form a slot(s) with the edge of the opening end of the panel, between which the binding strap can be inserted. The triangle arrangement may be generally immovable or can be pivotably affixed to the panel. Pivotable affixing of a triangular arrangement of the gripping means allows the triangle to rock such that a binding strap, placed in the slot between a first leg and the panel edge, will tend to be pinched when the binding strap is wrapped around the triangularly arranged gripping means and into the slot between a second leg and the panel edge.

It should be understood that the instant invention is not limited to triangular-shaped gripping means, and that appropriate means include other geometric forms that form a slot with the edge of the panel. For example, the shape may be generally elliptical, circular, polygonal or the like that form a slot when arranged with the edge of the panel.

BRIEF DESCRIPTION OF THE DRAWINGS

The nature and mode of operation of the present invention will now be more fully described in the following detailed description of the accompanying drawings.

FIG. 3 is a perspective view of the binder of FIG. 2, closed to secure materials;

FIG. 4 is a sectional view of the closed binder of FIG. 3 taken along line 4—4;

FIG. 5 is a fragmentary plan view of the gripping means of the open binder of FIG. 1;

FIG. 6 is a plan view of the gripping means showing placement of a binding strap, taken along line 6—6 of FIG. 3;

FIG. 7 is a perspective view of a further opened binder of the invention;

FIG. 8 is a perspective view of the binder of FIG. 7, closed to secure materials;

FIG. 9 is a fragmentary plan view of the gripping means of the opened binder of FIG. 7; and FIG. 10 is a plan view of the gripping means showing placement of a binding strap, taken along line 10—10 of FIG. 8.

DESCRIPTION OF THE PREFERRED EMBODIMENT

Figure 1:
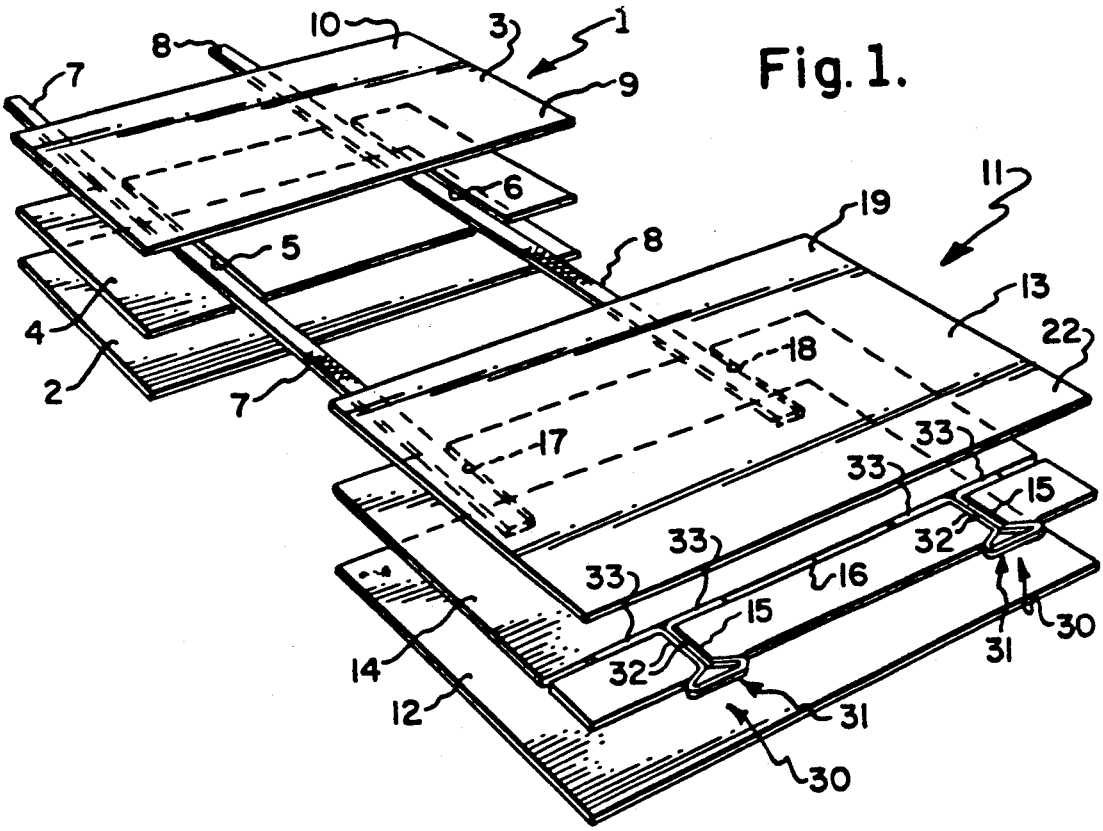
FIG. 1 is an exploded perspective view of an opened binder of the invention.
Figure 2:
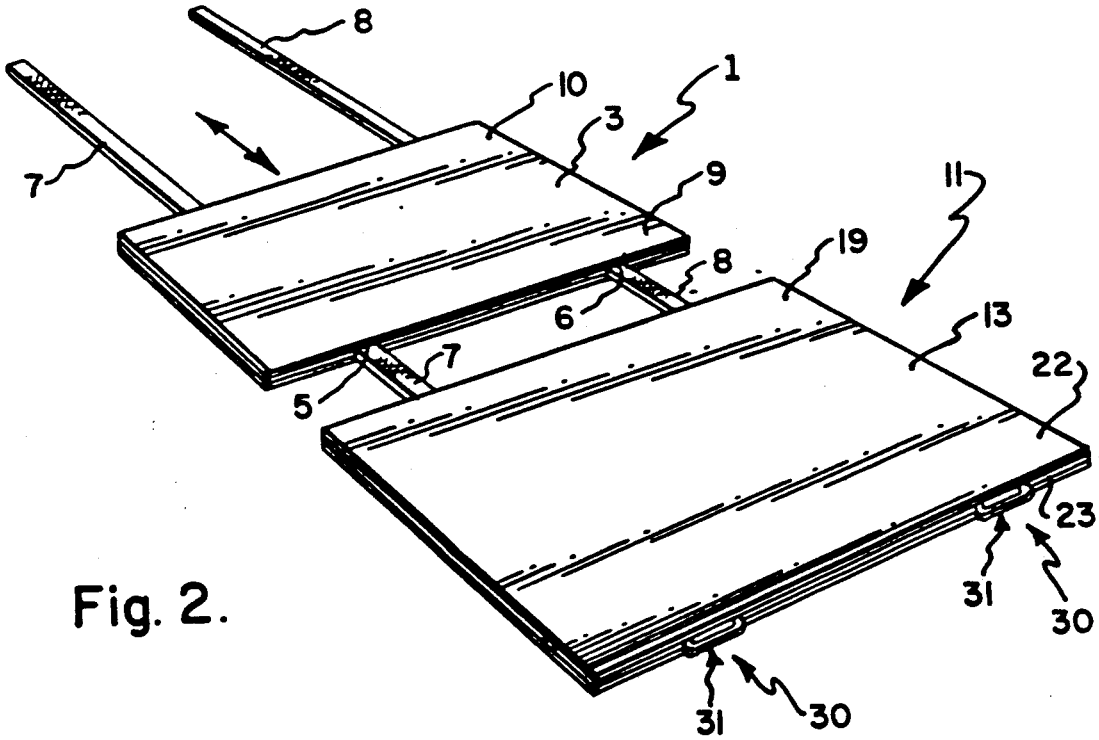
FIG. 2 is a perspective view of the assembled binder of FIG. 1.

Referring now to the drawings, FIGS. 1–6 illustrate a typical embodiment of the invention wherein first opposing panel 1, is illustrated as a laminate structure comprising an outer layer 2, inner layer 3 and middle spacer layer 4. In this embodiment, the outer and inner layers provide support for rigidizing the assembled panel 1, while spacer layer 4 comprises a convenient means to form generally parallel binder strap slots 5 and 6, through which binder straps 7 and 8 are slidably arranged. Alternately, each or both of layers 2 and 3 can be slotted in their facing surfaces, to provide a slot(s) for slidably arranging binder straps 7 and 8.

Second opposing panel 11 is also illustrated as comprising a laminate structure having an outer layer 12, inner layer 13 and middle spacer layer 14. In this embodiment, the outer and inner layers also provide support for rigidizing the assembled panel 11, while spacer layer 14 is illustrated as comprising gripping means mounting slots 15 and 16, for mounting gripping means 30 to the panel 11, and binder strap mounting slots 17 and 18 for mounting binder straps 7 and 8 thereto. Alternately, each or both of layers 13 and 14 can be slotted in their facing surfaces to provide means for mounting gripping means 30 and/or binder straps 7 and 8 to the panel.

Binder straps 7 and 8 are illustrated as being generally parallel and as being mounted to second panel 11 such that they extend from second panel hinging end 19 into binder strap slots 5 and 6, at hinging end 9 of first panel 1, and emerge from opening end 10 of panel 1. Binder straps 7 and 8 are typically glued within panel 11 during assembly, but may also be stapled or otherwise mechanically attached as may be desired. Binder strap slots 5 and 6 are dimensioned to allow slidable passage of binding straps 7 and 8 therethrough so that panel 1 can be moved, along binding straps 7 and 8, toward hinging end 19 of panel 11, for securing documents placed between the panels.

Gripping means 30 is illustrated in FIGS. 1–6 as being a relatively rigid metal or plastic wire or the like, formed to comprise the general shape of a triangle where it extends from edge 23 of opening end 22 of panel 11. Thus in FIGS. 1, 5 and 6, gripping means 30 is illustrated as being shaped to generally comprise a triangular head 31, parallel extension members 32 and oppositely extending feet 33. Oppositely extending feet 33 are arranged to engage gripping means mounting slot 16 and parallel extension members 32 to engage gripping means mounting slot 15, to provide supported mounting of gripping means 30 to panel 11. Triangular head 31 comprises base 34, leg 35 and leg 36. Legs 35 and 36 are acute angled (A) to base 34, and engage leg support slot 20. In a typical arrangement of gripping means 30, triangular head 31 extends outward from opening end edge 23 of panel 11 and base 34 is generally parallel to edge 23. Leg support slot 20 is typically dimensioned to allow some movement of legs 35 and 36 therein, such that triangular head 31 can be pivotably rocked forward and backward (B) along edge 23. Legs 35 and 36 of triangular head 31 form gripping slots 24 and 25 with edges 23 of opening end 22.

FIGS. 3 and 4 illustrate the binder in document securing position wherein panel 1 is arranged in opposing facing relation to panel 11, securing documents therebetween. Therein, binder straps 7 and 8 are secured to panel 11 and extend from the edge of hinged end 9 into binder strap slots 5 and 6 at the edge of hinged end 19 of panel 1. The binding straps are pulled through binder strap slots 5 and 6 to compress hinged ends 9 and 19 of panels 1 and 11, respectively, toward each other to the approximate gross thickness of documents 21 contained therebetween. The loose ends of binder straps 7 and 8, extending from the edge of opening end 10 of panel 1 are secured to the gripping means by wrapping them around triangular head 31 through gripping slots 24 and 25, formed at the exterior of triangular head 31, by legs 35 and 36, protruding from edge 23 to acute angled convergence with base 34. The dimensioning of leg support slot 20 allows triangular head 31 to rock such that a binding strap, placed in slot 25 between leg 36 and edge 23, will tend to move toward the convergence of the leg with the edge into the slot and be pinched in locking engagement at the divergence of the slot when the binding strap is wrapped around triangular head 31 and pulled through slot 24 between leg 35 and edge 23.

Referring now to FIGS. 7–10, therein is illustrated an embodiment of the invention wherein first opposing panel 41 and second opposing panel 51 are illustrated as comprising non-layered, polymeric structures. First opposing panel 41 comprises convenient binder strap slots 45, 46, 47 and 48, through which binder straps 43 and 44 are slidably arranged. Second opposing panel 51 is illustrated as comprising hinging end 52, opening end 53, opening end edge 54 and gripping means 55. Ends of binder straps 43 and 44 are attached to panel 51.

Binder straps 43 and 44 are illustrated as being arranged generally parallel. They are mounted to second panel 51 such that they extend around second panel hinging end 52, to first panel hinging end 42 and through binder strap slots 45 and 46. The binder straps then pass back through panel 41 at binder strap slots 47 and 48 and over first panel opening end 49.

Binder straps 43 and 44 are typically attached to panel 51 by gluing means, but may also be stapled or otherwise mechanically attached as may be desired. Alternately, slots may be provided in panel 51 for jam attachment of the straps. Binder strap slots 45, 46, 47 and 48 in panel 41 are dimensioned to allow slidable passage of binding straps 43 and 44 therethrough so that panel 41 can be moved, along binding straps 43 and 44, toward hinging end 52 of panel 51, to vary the distance between the panels for securing documents 50 placed between the panels.

Gripping means 55 is illustrated in FIGS. 7–10 as being an extension of the polymeric material of the panels, formed to comprise the general shape of a triangle where it extends from edge 54 of opening end 53 of panel 51. Therein, base 56 is illustrated as generally parallel to edge 54 with legs 57 and 58 being generally acute angled therefrom. In the illustrated figure, gripping slots 59 and 60 are formed between the edge 54 of panel 51 and gripping means 55. The loose ends of binder straps 43 and 44 extending from the edge of opening end 49 of panel 41 are secured to the gripping means by wrapping them around gripping means 55 through gripping slots 59 and 60. Dimensioning of the slots is such that the slot will pinch the binding strap in locking engagement when it is wrapped around gripping means 55.

It should be understood that though panels 41 and 51 are depicted as non-layered, each or both may contain decorative covers thereover. Various other modifications of the illustrated binders are evident therefrom which can be seen as providing equivalent functions in the binders, each of which are contemplated as within the scope of this invention.

I claim:

1. A binder comprising first and second opposing panels, each panel having a hinging end and an opening end; said first panel comprising gripping means for engaging a flexible strap at an edge of an opening end of said panel; said second panel comprising slot means for slidably engaging a flexible strap; flexible strap means extending from said hinging end of said first panel; said flexible strap means being arranged to pass through said slot means of said second panel to retain said second panel in adjustable, opposing juxtaposition to said first panel, by engaging said strap means with said gripping means.

2. The binder of claim 1 wherein said panels are generally rigid.

3. The binder of claim 1 wherein said flexible strap extends from said hinging end of said first panel to said hinging end of said second panel, engages said slot means of said second panel and extends from said opening end of said second panel to said gripping means.

4. The binder of claim 1 wherein said gripping means is arranged at an edge of said opening end of said first panel.

5. The binder of claim 1 comprising first and second slot means in said second panel to engage said flexible strap means.

6. The binder of claim 5 wherein said flexible strap extends through said first slot means at a hinging end of said second panel and through said second slot means at an opening end of said second panel.

7. The binder of claim 1 comprising two flexible strap means engaging spaced apart slot means in said second panel.

8. The binder of claim 7 wherein a first flexible strap means extends through a first slot means at said hinging end of said second panel and through another first slot means at said opening end of said second panel, and a second flexible strap means extends through a second slot means spaced apart from said first slot means at said hinging end of said second panel and through another second slot means at said opening end of said second panel.

9. The binder of claim 7 wherein said two flexible strap means are arranged generally parallel.

10. The binder of claim 1 wherein said slot means extends between layers of a laminate panel.

11. The binder of claim 5 wherein said second panel comprises a layered material and said flexible strap is arranged between layers of said panel as it extends between said first slot and said second slot means of said second panel.

12. The binder of claim 1 wherein said gripping means comprises a gripping slot that engages said flexible strap means.

13. The binder of claim 12 wherein said gripping slot is formed between an edge of said opening end of said first panel and said gripping means.

14. The binder of claim 12 wherein said gripping slot frictionally engages said strap.

15. The binder of claim 12 wherein said gripping means comprises material of said panel extending from an edge of said opening end of said panel.

16. The binder of claim 15 wherein said panel comprises a generally rigid polymeric material and said gripping means comprises polymeric material.

17. The binder of claim 16 wherein said gripping slot is formed between an edge of said opening end of said first panel and said gripping means.

18. The binder of claim 12 wherein said panel comprises a laminate material and said gripping means extends from an edge of an opening end of said panel.

19. The binder of claim 18 wherein said gripping means is movable.

* * * * *